US010472756B2

(12) United States Patent
Ronchi

(10) Patent No.: US 10,472,756 B2
(45) Date of Patent: Nov. 12, 2019

(54) TANK FOR WASHING A WARP THREAD

(71) Applicant: MASTER S.R.L., Macherio (IT)

(72) Inventor: Rinaldo Ronchi, Sovico (IT)

(73) Assignee: KARL MAYER TEXTILMASCHINENFABRIK GMBH, Obertshausen Offenbach (DE)

( * ) Notice: Subject to any disclaimer, the term of this patent is extended or adjusted under 35 U.S.C. 154(b) by 167 days.

(21) Appl. No.: 15/578,279

(22) PCT Filed: Jun. 10, 2016

(86) PCT No.: PCT/IB2016/053437

§ 371 (c)(1),
(2) Date: Nov. 30, 2017

(87) PCT Pub. No.: WO2016/199089

PCT Pub. Date: Dec. 15, 2016

(65) Prior Publication Data

US 2018/0142390 A1 May 24, 2018

(30) Foreign Application Priority Data

Jun. 11, 2015 (IT) ..... 102015000022918

(51) Int. Cl.
*D06B 3/04* (2006.01)
*D06B 3/20* (2006.01)
(Continued)

(52) U.S. Cl.
CPC ..... *D06B 3/04* (2013.01); *D06B 1/14* (2013.01); *D06B 1/16* (2013.01); *D06B 3/201* (2013.01)

(58) Field of Classification Search
CPC ... D06B 1/14; D06B 1/16; D06B 3/04; D06B 3/201
See application file for complete search history.

(56) References Cited

U.S. PATENT DOCUMENTS 897,133 A 8/1908 Palmer
2,940,288 A 6/1960 Walker
(Continued)

FOREIGN PATENT DOCUMENTS

DE 2533264 A1 2/1977
GB 922302 A 3/1963

OTHER PUBLICATIONS

International Search Report and Written Opinion for International Application No. PCT/IB2016/053437 (12 Pages) (dated Oct. 26, 2016).

*Primary Examiner* — Joseph L. Perrin
(74) *Attorney, Agent, or Firm* — Lucas & Mercanti, LLP

(57) ABSTRACT

The invention relates to a tank for washing a warp thread, provided with a device for intensifying the washing effect set in rotation inside the tank. Each device includes a body having cylindrical geometry, having circular cross section, which has a plurality of longitudinal bars arranged along the cylindrical side surface of the device. Between each pair of adjacent bars a longitudinal slit is defined. The body also has a pair of end elements extending radially, forming the opposite bases of the body and configured to support and enclose the bars. The body also has a pair of opposite rotation pins, obtained on the respective outer surfaces of the end elements and that extend along an axial direction and parallel to the direction of extension of the bars. The body also has a tangential turbodynamic flow generator, arranged inside the body and configured to intensify the interchange between the washing liquid and the warp thread through the longitudinal slits during the rotation of the device.

11 Claims, 2 Drawing Sheets

(51) Int. Cl.
*D06B 1/14* (2006.01)
*D06B 1/16* (2006.01)

(56) References Cited

U.S. PATENT DOCUMENTS 3,098,371 A * 7/1963 Fleissner ..... D06B 3/00
34/115
3,614,796 A * 10/1971 Tanaka et al. ..... D06B 3/00
8/151
3,690,758 A * 9/1972 Knechtel ..... G03G 15/108
399/248
4,070,878 A * 1/1978 Valls ..... D06B 3/201
68/205 R
4,479,276 A * 10/1984 Ziegler ..... D06B 3/201
68/158
5,588,170 A * 12/1996 Strahm ..... D06B 1/02
8/149.1
2005/0015889 A1* 1/2005 Zikeli ..... D06B 1/16
8/156

* cited by examiner

TANK FOR WASHING A WARP THREAD

CROSS-REFERENCE TO RELATED APPLICATIONS

This application is a 371 of PCT/IB2016/053437, filed Jun. 10, 2016, which claims the benefit of Italian Patent Application No. 102015000022918, filed Jun. 11, 2015.

FIELD OF THE INVENTION

The present invention refers in general to a tank for washing textile materials and, more specifically, to a device for intensifying the washing effect of textile materials, specifically suitable for the continuous treatment of chains of yarns for warps and/or fabrics.

BACKGROUND OF THE INVENTION

In single machines and in lines with continuous processes for dyeing and ennobling yarns and fabrics there are always tanks that carry out various hot washing operations. In all of these operations there is substantial consumption of water and of heat energy. Environmental and economic requirements to reduce water and heat energy consumption and the need to be able to carry out more efficient washes, required by new wet finishing processes of fabrics, as well as by the standards of the various consumer protection eco-labels, must lead to a solution to this problem being identified.

The efficiency of a wash, both as intermediate operation, and as final operation of a given textile cycle, must not be undervalued. Very often, indeed, the efficiency of the wash is determinant both for the successful outcome of the subsequent operations for the purposes of the quality of the product, and since the washing operation constitutes a substantial part of the processing costs.

A typical ennoblement application of yarns is that of their continuous mercerization and dyeing to produce fabrics commonly called "denim". Denim is a fabric used to make blue jeans and "sportswear" items in general, and it is the most used fabric in the world. Classic denim is manufactured by weaving pre-dyed cotton threads. In particular, only the warp is dyed continuously, with indigo or other dyes, whereas the weft is used untreated.

In continuous lines for dyeing chains of warp for denim fabric with indigo, the hot washes after the preparatory operations of scouring, pre-dyeing or mercerization are numerous and have the function of eliminating the greatest possible amount of impurities of the threads, consisting of their reaction products and the substances used in the formulation of the treatment bath. In the case of mercerization, for example, it concerns eliminating the sodium hydroxide absorbed by the yarn, so as to avoid use of the neutralisation operation or, at the very least, to reduce the amount of acid necessary for the purpose. The washes after dyeing, on the other hand, have the purpose of eliminating the parts of dye not properly fixed to the fibre, an operation of essential importance for the dyeing quality of the yarn and the subsequent finishing processes of the fabric.

For these operations, one or more tanks are normally used, arranged in line, each of which contains one or more return and guiding cylinders immersed in the washing bath, as well as a pair of wringing cylinders or "foulards" arranged at the outlet of the textile material from the tank. Sometimes, to save water, the tanks are connected through pipes to operate in countercurrent to each other. Although it is a very particular ennoblement process, to wash the thousands of paired threads, such as the chains of warp or warp thread, the normal washing tanks for fabric have still always been used, but with poor washing effect and high specific consumption of water and heat energy.

A certain improvement is obtained with the washing devices illustrated in Italian patents no. 01276825 and no. 01298448 to the same Applicant. The advantages of such washing devices, however, have been practically offset by a series of problems, including that caused by spraying systems that, being able to become blocked locally, cause the breaking down of the organised configuration of the threads, creating harmful creasing and breaking.

Further washing devices for textile materials are described, for example, in documents GB 922 302 A and U.S. Pat. No. 897,133 A. In particular, document GB 922 302 A illustrates a device for intensifying the washing effect able to be used exclusively for washing fabrics. Such a device for intensifying the washing effect, during the rotation and thanks to its polygonal shape, subjects the fabric, intermittently, to flexing, tension and beating action. In the case of use with a warp thread, this would involve the decomposition of the organised configuration of the warp thread with overlapping of threads, with consequent uneven wringing, dyeing and starching and with high probability of the threads breaking. The device for intensifying the washing effect illustrated in document GB 922 302 A is thus unsuitable for washing yarns.

In the device for intensifying the washing effect illustrated in document GB 922 302 A the efficiency of washing is down to the pressure inside a perforated central tube. The pressure is generated by two propellers arranged at the ends of such a tube, respectively. The propellers, in an opposite manner, thrust the washing water inside the perforated central tube. Considering that the cylinders of the normal washing tanks have a maximum outer diameter of 150/160 mm, it can be presumed that the perforated central tube has a maximum diameter of 120/130 mm. In the case of washes for continuously dyed yarns the operative speed is 25/30 metres per minute and therefore the propellers, with diameter 120/130 mm, would rotate at most at 65/70 revs/min., with a negligible flow rate and certainly not capable of creating an internal pressure in a perforated tube. In the case of low-speed processing, the flow rate of the propellers would be practically zero, for which reason the washing efficiency of the device for intensifying the washing effect illustrated in document GB 922 302 A is limited and not constant.

The device for intensifying the washing effect illustrated in document GB 922 302 A is very complex in construction, being provided with a rotation shaft integral with the perforated central tube through inner spokes, a central diaphragm, outer blades with dividing rings, cells, spaces, lateral propellers, etc. In continuous dyeing lines with indigo, concerning eliminating of the pigment not fixed to the fibre from the yarn, this construction, wherein many recesses are provided, lends itself to the formation of deposits of pigment, of fur and of other residues. This can also create clogging or obstruction of the holes of the central tube. The complexity of the device for intensifying the washing effect illustrated in document GB 922 302 A makes the cleaning operation thereof difficult.

The device for intensifying the washing effect illustrated in document U.S. Pat. No. 897,133 A, even with minimal constructive differences, has the same drawbacks as the device for intensifying the washing effect illustrated in document GB 922 302 A in terms of inefficiency and lack of consistency of the washing effect. In particular, there is a functional contradiction that consists of the fact that the device for intensifying the washing effect illustrated in document U.S. Pat. No. 897,133 A would operate on the basis of two mutually conflicting fluid-dynamic principles. Indeed, document U.S. Pat. No. 897,133 A specifies both that in the cylinder, through the respective propellers, a stream of liquid is generated from inside towards outside, and that the liquid will flow readily inside the cylinder through the slits formed on the surface of such a cylinder.

SUMMARY OF THE INVENTION

The purpose of the present invention is therefore to make a tank for washing textile materials and, more specifically, a device for intensifying the washing effect of textile materials, which is able to overcome the aforementioned drawbacks of the prior art in an extremely simple, cost-effective and particularly functional manner.

In detail, a purpose of the present invention is to make a device for intensifying the washing effect of textile materials that is applicable to any type of washing tank and that, autonomously, in other words without the use of motors, pumps, nozzles, filters, etc., creates a high water/yarn interchange, making the washing action as efficient as possible and, consequently, allowing the consumption of water and of heat energy to be drastically reduced with respect to devices according to the prior art.

Another purpose of the present invention is to make a device for intensifying the washing effect of textile materials that does not require control members and that cannot become clogged, thus not creating problems for the organised configuration of the yarn.

A further purpose of the present invention is to make a device for intensifying the washing effect of textile materials that ensures the perfect uniformity of its action on the entire width of the warp thread.

Yet another purpose of the present invention is to make a device for intensifying the washing effect of textile materials that is extremely simple to construct, whilst still maintaining a strong and versatile structure, and that does not require particular care or maintenance.

These and other purposes according to the present invention are accomplished by making a tank for washing textile materials and, more specifically, a device for intensifying the washing effect of textile materials, as outlined in claim 1.

Further characteristics of the invention are highlighted by the dependent claims, which are an integral part of the present description.

In general, the device for intensifying the washing effect of textile materials according to the present invention is particularly suitable for the continuous treatment of fabrics and/or chains of warp yarns and substantially consists of a structure made up of longitudinal elements with circular arrangement, integral with external elements carrying the rotation pins. Inside the structure a tangential turbodynamic flow generator is arranged, configured to intensify the interchange between water and yarn. The device for intensifying the washing effect of textile materials according to the present invention is applicable to all systems and processes for continuously ennobling fabrics and yarns, in particular to the respective washing tanks.

This device, which can be made with any diameter and width and with any number of longitudinal elements of any section and profile, can be positioned individually or in any number in any washing tank, and/or for various treatments, replacing the classic cylinders that accompany the immersion of the yarn or of the fabric.

The tangential turbodynamic flow generator arranged inside this device, at each revolution of the device itself, performs the expulsion of the entire volume of water or of bath contained in it, thrusting it, with moderate kinetic energy, to pass through the warp thread or the fabric that partially wraps around it and thus enormously increasing the interchange with the yarn and/or the fabric with respect to conventional cylinders. This great volume of water or bath that forcibly and uniformly, without turbulence and possibility of decomposition of the organised configuration of the yarn, flows through the yarn and/or the fabric enormously increases the efficiency of the wash, allowing a drastic reduction of the consumption of water, of heat energy and also of the number of tanks to be used for these operations.

Such reductions mean a substantial saving in bulk and in investments for the washing tanks, as well as a substantial saving for the cost of extra water, for heating it and also for purifying the final polluted water that is discharged from the tank. Moreover, in the specific case of dyeing with indigo, the greater concentration of the dye in a smaller amount of water of the final washes ensures that the size of the possible ultra-filtration system for recovering dye from the washing water is substantially reduced, with savings both in investment and in operating costs.

BRIEF DESCRIPTION OF THE DRAWINGS

The characteristics and advantages of a tank for washing textile materials and of a device for intensifying the washing effect of such textile materials according to the present invention will become clearer from the following description, given as an example and not for limiting purposes, referring to the attached schematic drawings, in which.

DETAILED DESCRIPTION OF THE INVENTION

Figure 1:
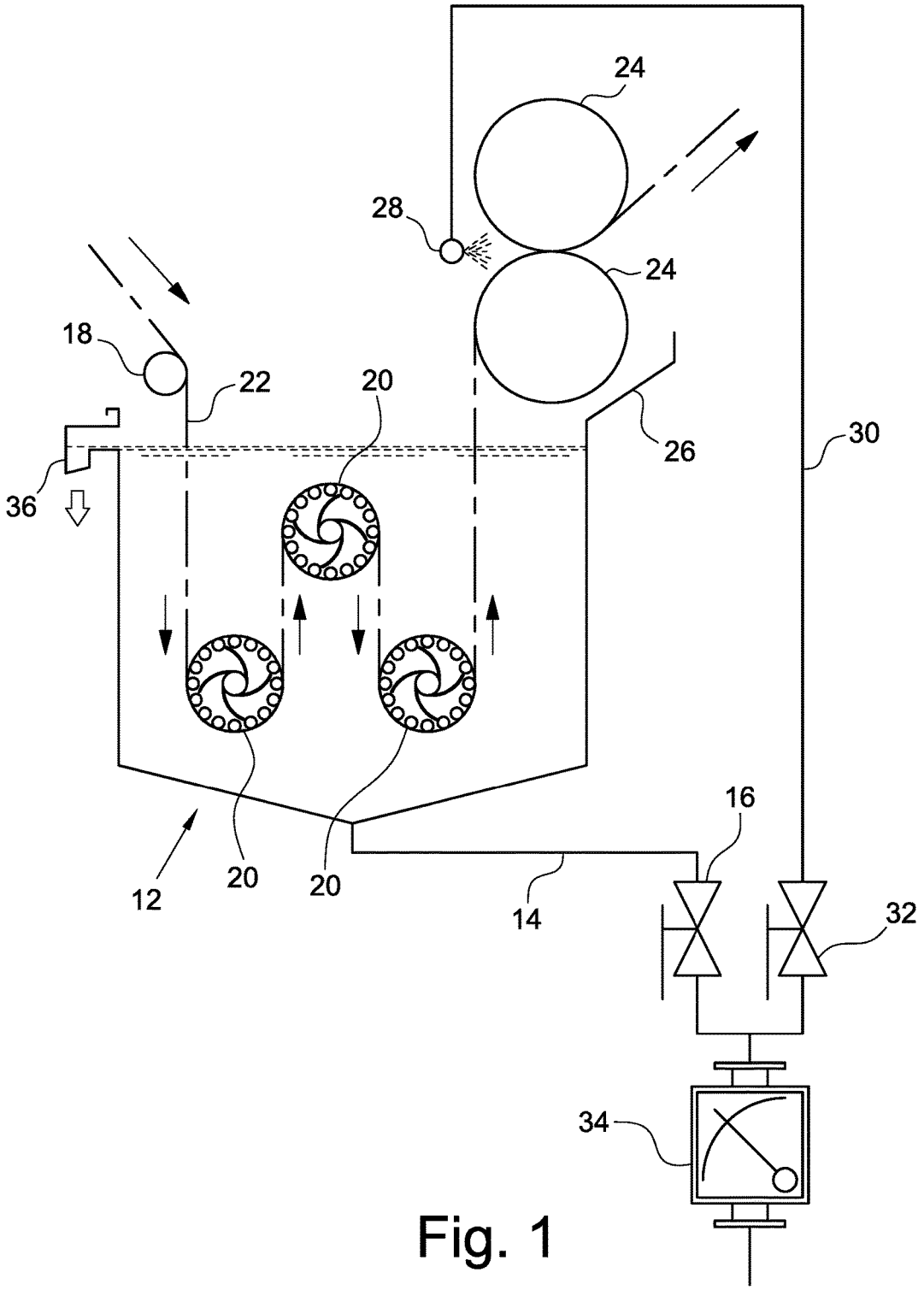
FIG. 1 is a schematic view of a generic tank for washing textile materials on which three devices for intensifying the washing effect according to the present invention are installed.

With reference in particular to FIG. 1, a generic tank for washing textile materials is shown, wholly indicated with reference numeral 12. The tank 12 is parallelepiped shaped, open on top and equipped with a generically convex bottom, in this case tile-shaped. The tank 12 is filled with a liquid or washing bath, like for example water.

At least one first feeding pipe 14 for the washing liquid extends from the bottom of the tank 12. The first feeding pipe 14 is intercepted by a first adjustment valve 16. Immediately above the tank 12, on the other hand, there is at least one guide roller 18, configured to convey the textile material, consisting of a warp thread 22, inside the tank 12 itself, so that the warp thread 22 is immersed in the washing liquid for a predetermined length portion thereof. The warp thread 22 moves in the direction of the arrows based on a predetermined linear speed that, in general, constitutes a parameter imposed for the dyeing operation.

One or more devices 20 for intensifying the washing effect of the warp thread 22 are arranged inside the tank 12. Each device 20 consists of a body having cylindrical geometry immersed in the washing liquid. The term body having cylindrical geometry is meant to indicate the location of the generatrix lines, parallel to a predetermined direction and passing through the single points of a given directrix curve, in this specific case consisting of a circumference. In other words, each device 20 consists of a body having cylindrical geometry with circular cross section. The devices 20, described in greater detail hereinafter, are configured to define a guided path for the warp thread 22 inside the washing liquid contained in the tank 12 when such a warp thread 22, moved by two or more wringing cylinders 24, at least partially wraps around such devices 20.

After the aforementioned guided path in the washing liquid, the warp thread 22 rises and passes through two or more wringing cylinders 24, commonly called "foulards", positioned above the tank 12 and configured to eliminate at least part of the washing liquid that impregnates such a warp thread 22 exiting such a tank 12. The wringing cylinders 24 are motorised, are actuated at a controlled speed, which determines the advancing speed of the warp thread 22, and are configured to apply an adjustable pressure on such a warp thread 22. The tank 12 is thus provided, at the wringing cylinders 24, with a countersunk portion 26 of its upper edge, which allows the washing liquid wrung by the wringing cylinders 24 themselves to fall back into the tank 12 and be reused.

At the wringing cylinders 24 and, more precisely, upstream of such wringing cylinders 24, there can also be a spraying group 28 of the warp thread 22, hydraulically connected to a second feeding pipe 30 for the washing liquid. The second feeding pipe 30 is intercepted by a second adjustment valve 32.

The washing liquid in inlet both into the first feeding pipe 14 of the tank 12, and into the second feeding pipe 30 of the spraying group 28, can be measured through a flow meter 34, whereas the adjustment of the flow rate is carried out through the adjustment valves 16 and 32. Both the first adjustment valve 16, and the second adjustment valve 32 are thus slaved to such a flow meter 34 for measuring the flow rate. The washing liquid introduced with the spraying group 28 flows in counter-current with respect to the advancing direction of the warp thread 22, which rises towards the wringing cylinders 24.

The tank 12 is finally equipped, at its upper edge, with at least one overflow duct 36 that keeps the amount of washing liquid contained in the tank 12 itself constant. The overflow duct 36 is sized to discharge from the tank 12 an amount of washing liquid greater than the maximum flow rate that can be fed with the flow meter 34.

Figure 2:
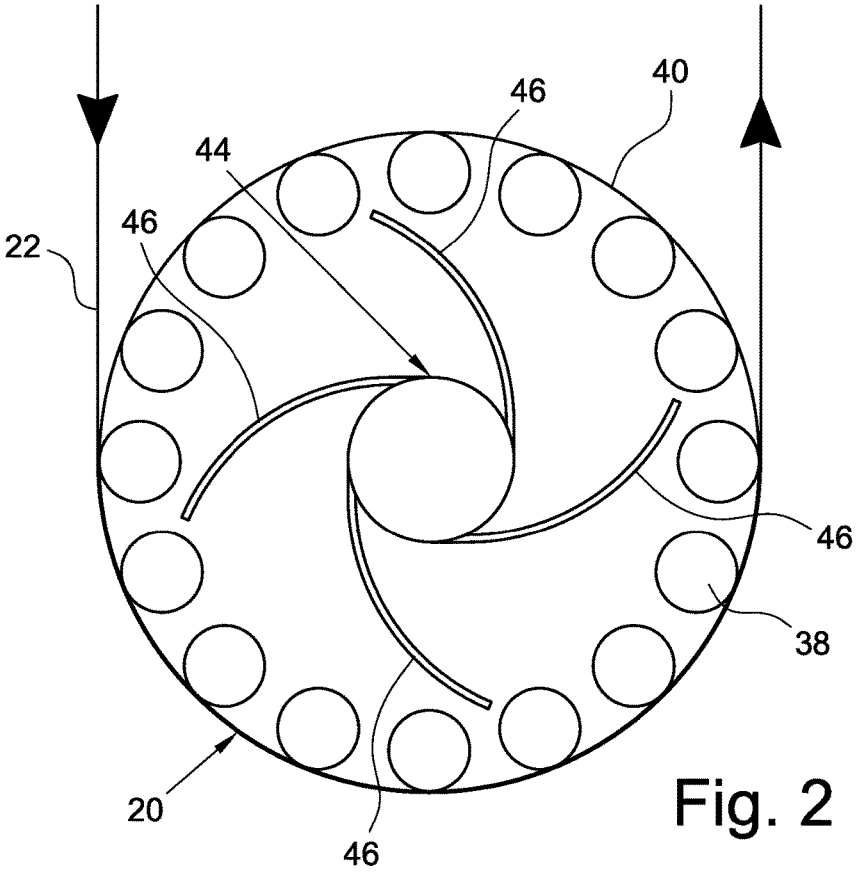
FIG. 2 is a section view of a device for intensifying the washing effect of textile materials according to the present invention.

According to the invention, each device 20 for intensifying the washing effect of the warp thread 22 comprises a plurality of longitudinal bars 38, in other words parallel to the generatrix lines of the cylindrical body that constitutes the device 20 itself. In other words, the bars 38 are arranged along the cylindrical side surface of the device 20. As shown in FIG. 2, each bar 38 advantageously has a circular shape in cross section, so as not to break down the organised configuration of the warp thread 22, avoiding the overlapping of the respective threads. Between each pair of adjacent bars 38 a longitudinal slit of length substantially equal to the length of such bars 38 is defined.

Each device 20 also comprises a pair of end elements 40 extending radially, forming the opposite bases of the cylindrical body that constitutes the device 20 itself. The end elements 40, made in the form of circular plates, support and enclose the longitudinal bars 38, with which such outer elements 40 are made integral. Preferably, as shown in FIG. 2, the longitudinal bars 38 are joined to the respective end elements 40 close to the circumferential edges of such end elements 40.

Figure 3:
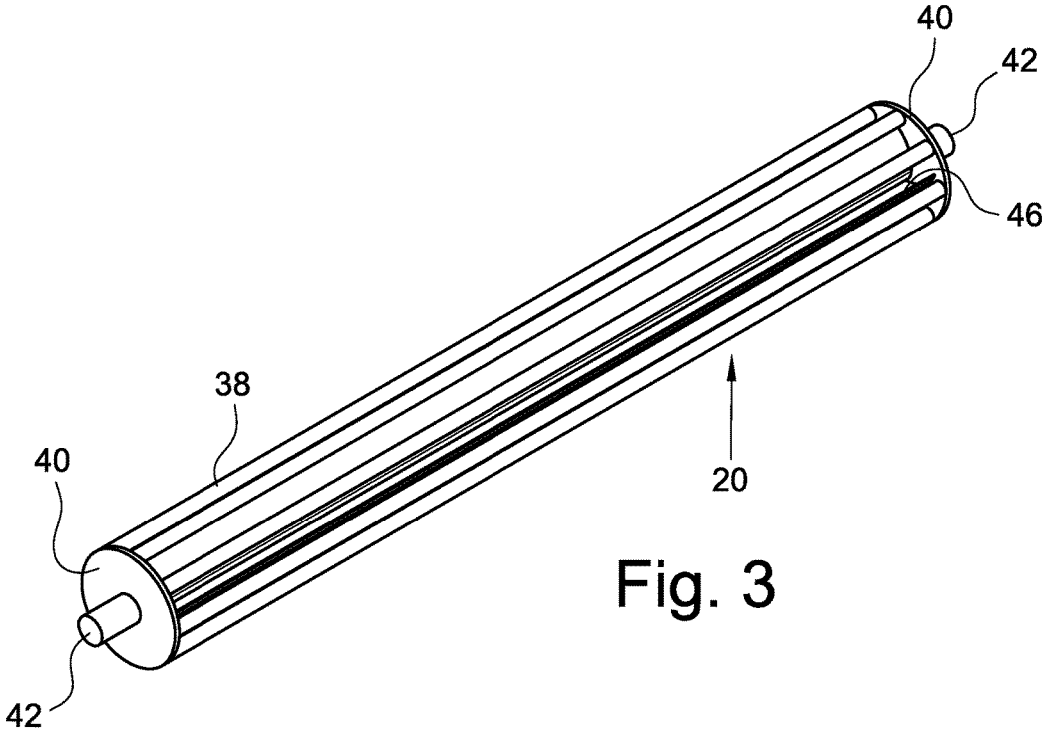
FIG. 3 is an axonometric view of the device of FIG. 2.

Each end element 40 also supports, on the respective outer surface, a corresponding rotation pin 42 that extends along an axial direction (FIG. 3) and parallel to the direction of extension of the bars 38. The two opposite pins 42 are operatively and rotatably connected to predetermined portions of the tank 12 to allow the rotation, induced by the movement of the warp thread 22, of the respective cylindrical body that constitutes each device 20.

Inside the cylindrical body that constitutes the device 20 a tangential turbodynamic flow generator 44 is arranged, configured to intensify the interchange between the washing liquid and the warp thread 22 during the rotation of such a device 20 through the longitudinal slits of the device 20 itself. The tangential turbodynamic flow generator 44 consists of a rotor provided with one or more suitably shaped blades 46, arranged longitudinally inside the cylindrical body that constitutes the device 20. Each blade 46 advantageously has a length in the longitudinal direction that is substantially equal to the length of each longitudinal bar 38. The rotor is made integral with the end elements 40 of the device 20.

As shown in FIG. 2, each blade 46 has a profile in cross section shaped like an arc of circumference, suitable for generating a predetermined thrust on the washing liquid, and has a width in the radial direction such as to occupy as much space as possible inside the cylindrical body that constitutes the device 20, in other words a width in the radial direction that is substantially equal to the radius of the directrix circumference of the cylindrical body that constitutes the device 20. As shown in the non-limiting example embodiment of FIG. 2, each blade 46 can be shaped like an arc of circumference in section, but this does not exclude the possibility of making the blades 46 with other shapes in section, like for example a flat shape, a generically curved shape or a shape of an open broken line.

Thanks to the profile and the dimensions of the blades 46 of the tangential turbodynamic flow generator 44, for each complete revolution of the device 20 about the pins 42 such blades 46 perform the expulsion of the entire volume of washing liquid contained inside the cylindrical body that constitutes such a device 20. The blades 46 thus thrust, with moderate kinetic energy, the aforementioned volume of washing liquid to pass through the warp thread 22 that partially wraps around the device 20, thus enormously increasing the interchange of washing liquid with the warp thread 22 itself with respect to conventional cylinders.

It has thus been seen that the device for intensifying the washing effect of textile materials according to the present invention achieves the purposes outlined earlier, in particular obtaining the following advantages:

- efficiency of washing;
- total elimination of the pigmented dye;
- complete cleaning of the yarn;
- considerable reduction of water consumption;
- possibility of reduction of the number of washing tanks in one same system;
- environmental and economic advantage;
- technological advantages in the final treatments of the fabric;
- commercial advantages (better visual appearance of the fabric, white weft);
- absence of filters, clogging and stress on the yarn.

The device for intensifying the washing effect of textile materials of the present invention thus conceived can in any case undergo numerous modifications and variants, all of which are covered by the same inventive concept; moreover, all of the details can be replaced with technically equivalent elements. In practice, the materials used, as well as the shapes and sizes, can be whatever according to the technical requirements.

The scope of protection of the invention is therefore defined by the attached claims.

The invention claimed is:

1. A tank for washing a warp thread through a washing liquid, comprising a device for intensifying the washing effect of said warp thread, each device being configured to be set in rotation inside said tank and consisting of a body having cylindrical geometry with a circular cross section that comprises:

a plurality of longitudinal bars, arranged along the cylindrical side surface of each device, a longitudinal slit being defined between each pair of adjacent bars;

a pair of end elements extending radially, forming the opposite bases of said body having cylindrical geometry, said end elements being configured to support and enclose said bars;

a pair of opposite rotation pins, obtained on the respective outer surfaces of said end elements, said rotation pins extending along an axial direction and parallel to the direction of extension of said bars; and a tangential turbodynamic flow generator, arranged inside said body having cylindrical geometry and configured to intensify the interchange between the washing liquid and the warp thread through said longitudinal slits during the rotation of each device, wherein each bar of each device has a circular shape in cross section, so as not to break down a configuration of the warp thread, avoiding overlapping of respective threads.

2. The tank according to claim 1, wherein each longitudinal slit has a length substantially equal to the length of said bars.

3. The tank according to claim 1, wherein said end elements are made in the shape of circular plates.

4. The tank according to claim 3, wherein said bars are joined to the respective end elements close to the circumferential edges of said end elements.

5. The tank according to claim 1, wherein the tangential turbodynamic flow generator consists of a rotor provided with one or more blades arranged longitudinally inside said body having cylindrical geometry, said rotor being integral with said end elements.

6. The tank according to claim 5, wherein each blade has a length in the longitudinal direction substantially equal to the length of each of said bars.

7. The tank according to claim 5, wherein each blade has a profile in cross section shaped like an arc of circumference, suitable for generating a predetermined thrust on the washing liquid, and has a width in the radial direction that is substantially equal to the radius of the directrix circumference of said body having cylindrical geometry so that, for each complete revolution of each device around the respective rotation pins, said blades are capable of expelling the entire volume of washing liquid contained inside said body having cylindrical geometry.

8. The tank according to claim 1, further comprising:

a guide roller, configured to convey the warp thread inside said tank so that said warp thread is immersed in the washing liquid for a predetermined length portion thereof;

two or more motorized wringing cylinders, positioned above said tank and through which said warp thread passes;

wherein each device is immersed in the washing liquid and is configured to define a guided path for the warp thread inside said washing liquid when said warp thread, moved by said two or more motorized wringing cylinders, winds at least partially around each device.

9. The tank according to claim 8, wherein said two or more motorized wringing cylinders are configured to apply an adjustable pressure on said warp thread, so as to eliminate at least part of the washing liquid that impregnates said warp thread exiting from said tank.

10. The tank according to claim 9, further comprising a spraying group for spraying the warp thread, arranged upstream of said two or more wringing cylinders and hydraulically connected to a feeding pipe for the washing liquid.

11. The tank according to claim 10, further comprising a flow meter and an overflow duct arranged at the upper edge of said tank, said overflow duct being configured to keep the amount of washing liquid contained in said tank constant and being sized to discharge from said tank an amount of washing liquid greater than the maximum flow rate that can be fed with said flow meter.

* * * * *